United States Patent [19]

Stephenson, Sr. et al.

[11] 4,401,098

[45] Aug. 30, 1983

[54] WOOD BY-PASS FURNACE

[76] Inventors: Peter S. Stephenson, Sr., Stinesville, Ind.; Ellis D. Stephenson, heir, 913 S. 19th St., Chesterton, Ind. 46304

[21] Appl. No.: 252,201

[22] Filed: Apr. 8, 1981

[51] Int. Cl.[3] ..... F24C 1/14

[52] U.S. Cl. ..... 126/61; 126/34; 126/67; 126/123; 126/126

[58] Field of Search ..... 126/61, 34, 123, 126, 126/60, 79, 67, 77, 80

[56] References Cited

U.S. PATENT DOCUMENTS

| | | | |
|---|---|---|---|
| 543,742 | 7/1895 | Loy et al. | 126/61 |
| 781,705 | 2/1905 | Woods | 126/60 |
| 2,810,380 | 10/1957 | Critten | 126/61 X |
| 4,030,479 | 6/1977 | Webb | 126/287 |
| 4,192,285 | 3/1980 | Nietupski | 126/60 X |
| 4,206,743 | 6/1980 | Niemela | 126/61 X |

*Primary Examiner*—Larry Jones

[57] ABSTRACT

This wood by-pass furnace is designed in such a manner, as to have the oxygen for combustion controlled, to the extent that the wood does not blaze, but only produces red, glowing coals for heating a home, and the outside cover will not burn anyone when touched. It primarily consists of an inside fire chamber of cylindrical shape, to distribute heat to the top, and it includes a top baffle, that extends from the front of the fire chamber, to the rear of the furnace. It further includes two side baffles, to protect the sides of the heat chamber, and smoke and heat travels up and over the top of the top baffle, to the front of the stove or furnace, and passes out an eight inch pipe. The top baffle further serves to condense the black smoke into liquid, which will dry out and will burn in its dry form.

3 Claims, 4 Drawing Figures

COLD AIR INLET CONNECTED TO HEATING SYSTEM

WOOD BY-PASS FURNACE

This invention relates to home heating devices, and more particularly, to a wood by-pass furnace.

It is, therefore, the principal object of this invention to provide a wood by-pass furnace, which will be unique in structure, so as to produce a desired amount of heat, while consuming only a small quantity of wood, as compared to furnaces of the prior art.

Another object of this invention is to provide a wood by-pass furnace, which will be of such structure, as to have a horizontal and cylindrical fire chamber with baffle means, to enable the heat produced to be distributed to the top, and the fire will burn from the front to the rear of the first chamber.

Another object of this invention is to provide a wood by-pass furnace, which will be of such structure, that the oxygen for combustion will be controlled, to the extent that the wood will not blaze, but only produce red, glowing coals.

A further object of this invention is to provide a wood by-pass furnace, which will not cause a burn on a person's hands when touched.

A still further object of this invention is to provide a wood by-pass furnace, which will be safe, as well as economical in use.

Other objects of the present invention are to provide a wood by-pass furnace, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4:
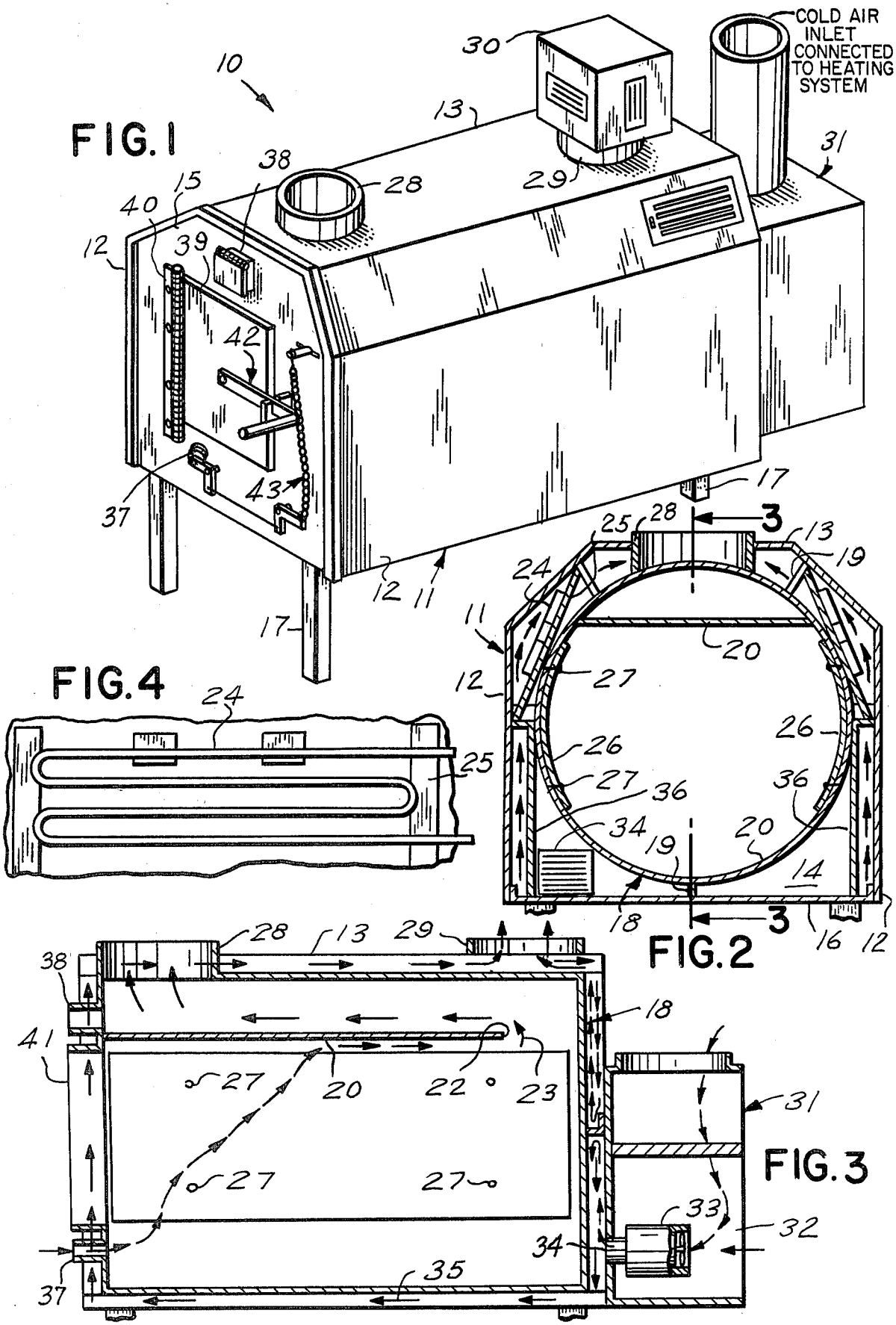
FIG. 1 is a perspective view of the present invention.
FIG. 2 is a vertical and enlarged cross-sectional view of FIG. 1.
FIG. 3 is a cross-sectional view, taken along the line 3—3 of FIG. 2.
FIG. 4 is a fragmentary and cross-sectional view of an optional hot water heater coil, that may be installed inside of the invention, if desired.

According to this invention, a furnace 10 is shown to include a metal housing 11, having a pair of side walls 12, a top cover 13, end walls 14 and 15, and a bottom wall 16. A plurality of space-apart legs 17, of suitable structure, are fixedly secured to bottom wall 16 in a manner (not shown) so as to support housing 11. A horizontal and cylindrical fire chamber 18 is fixedly secured in housing 11 by support members 19, in a suitable manner, and a top baffle plate 20 is secured fixedly, at one end, to end wall 15 of fire chamber 18, and the longitudinal side edges of baffle plate 20 are fixedly secured to the inner periphery 21 of fire chamber 18, the opposite end of plate 20 being free, and defining an opening 22 for hot air flow, as indicated by means of the arrows 23. An optional length of coiled copper tubing 24 is secured by members 19 and 25, on the outside of fire chamber 18, so as to carry water to be heated, if desired, and a pair of oppositely opposed side baffle plates 26 are secured to the inner periphery 20 of fire chamber 18, by means of a plurality of bolt fasteners 27, the side baffle plates 26 serving to protect the sides of the fire chamber 18.

A smoke outlet pipe 28 is fixedly secured near the forward end of fire chamber 18, in a suitable manner, and extends through cover 13, for receiving a connectable pipe (not shown), that will extend outside of the user's residence, or the like. A heat service pipe 29 extends from, and is suitably secured to, top cover 13, for the outlet of heated air, and the top cover extends two inches past the front and rear of fire chamber 18. A heat register box 30 may be placed at the rear of furnace 10, so as to be used if needed, and a clean-out door 38 is received on housing 11, so as to clean top baffle plate 20. A box 31 is fixedly secured to rear wall 14 of furnace 10, and includes an inlet 32 for cold air to be drawn in, by means of a blower 33. Blower 33 blows cool air out of outlet 34, where it travels as indicated, by arrows 35, in the bottom of furnace 10, and the cool air is confined within the side members 36, as is more clearly seen in FIG. 2 of the drawing. On the bottom front of fire chamber 18 is a vent 37, and, at the top, is a door 38. A walk-plate door 39 is secured by hinge 40, over the opening 41, in which wood is placed for burning in the fire chamber 18, and a latch and handle combination 42, common in the art, is used to cover and uncover opening 41. A thermostat and chain combination 43, also common in the art, is provided on the front of furnace 10, for control thereof.

In use, after wood is placed in opening 41 of fire chamber 18, and ignited, the heat is distributed to the top, and as the fire burns from the front to the rear of chamber 18, the smoke and heat travels up over the top baffle plate 20, to the front of the furnace 10, thus, heating the bottom and top of furnace 10, prior to entering the smoke pipe 28. When burning is taking place, the top baffle 20 will condense a portion of the black smoke into liquid, that will dry out and will burn in its dry form, and the door 38 enables access to top baffle plate 20, for its cleaning. Vent 37 is also used to control the amount of draft on the flue, and it should be recognized, that all wood or solid fuels give off volatile gases and water vapor when burned, and the aforementioned is what is condensed by baffle plate 20 means, so as to be burned in dry form. The caged-type blower 33 draws air from the cold air plenum, through the cold air draft box 31 and filter, and forces the air and heat through the bottom half of furnace 10, up and around each side of the door 39, and back through the top half of furnace 10, and then out through pipe 29, into hot plenum of gas, oil, or electric furnaces. In this way, it does not interfere with the operation of the aforementioned furnaces. The blower 33 runs continually, and furnace 10 includes an electric control (not shown), that closes at one hundred thirty-five degrees, and opens at ninety degrees, and thus, the blower thirty-three comes on at one hundred thirty-five degrees, and shuts off at ninety degrees. The thermostat and chain combination 43 also enables the fire chamber 18 to operate at one hundred thirty-five degrees.

It shall also be noted, that furnace 10 can be set for any heat range needed and will operate twelve hours, at one hundred forty degree heat, on a very small amount of wood, and will heat the average home twelve hours on three medium-size pieces of wood.

It shall further be recognized, that the copper tubing 24 has an overall length of thirteen feet, and includes a safety valve on one side (not shown), and is connected to a cold water service line, and the other side of the line is connected to the hot water inlet, the above-mentioned enabling cold water to be heated to one hundred thirty-five degrees, before entering the hot water tank, and this tubing 24 is optional.

While various changes may be made in the detail construction, it is understood that such changes will be within the spirit and scope of the present invention, as is defined by the appended claims.

It is claimed:

1. A wood by-pass furnace, comprising: a horizontal housing; a horizontal fire chamber secured in said housing for receiving wood to be burned, said fire chamber being positioned in said housing to provide passageway means between the bottom, top, sides, and front and rear ends of the fire chamber and the housing; a door on the front of the housing for introducing wood into the fire chamber; a horizontal baffle plate secured to the fire chamber in spaced relation to the top thereof, said baffle plate defining passageway means in the fire chamber and acting to deflect and direct heated air rearwardly and then forwardly in the fire chamber, and, further to delay the exit of heated air and smoke from the fire chamber; a pair of opposed plates secured in overlying relation to the sides of the fire chamber for shielding the sides of the fire chamber from hot ashes in the fire chamber; a draft air box secured to the rear of the housing for directing cool air into the passageway means at the rear and the bottom of the furnace; controlled air intake means at the front of the housing for directing unheated air into the fire chamber to support burning of wood in the fire chamber; a smoke outlet pipe at the front of the furnace in communication with the passageway means in the fire chamber defined by the horizontal baffle plate; and heated air outlet means at the rear of the furnace in communication with the passageway means between the top of the fire chamber and the housing.

2. A wood by-pass furnace according to claim 1, wherein a door is provided in the front wall of the housing to enable the top of the horizontal plate to be cleaned.

3. A wood by-pass furnace according to claim 1 wherein tubing, connected at one end to a cold water service line and at another end to a hot water tank, is positioned in the passageway means between the sides of the fire chamber and the housing.

* * * * *